United States Patent [19]

Sherwood

[11] 4,417,609

[45] Nov. 29, 1983

[54] COMBINATION COUPON CARRIER AND BAG STIFFENER

[76] Inventor: Tom W. Sherwood, 1698 Raindance Way, Las Vegas, Nev. 89109

[21] Appl. No.: 317,323

[22] Filed: Nov. 2, 1981

Related U.S. Application Data

[63] Continuation-in-part of Ser. No. 255,540, Apr. 20, 1981, Pat. No. 4,379,519.

[51] Int. Cl.[3] ..... B65B 1/04

[52] U.S. Cl. ..... 141/98; 141/390; 283/56; 383/33; 229/70

[58] Field of Search ..... 229/55; 283/56; 40/2; 141/316, 390, 391, 98

[56] References Cited

U.S. PATENT DOCUMENTS 3,822,524 7/1974 Jerpbak ..... 141/390

4,305,605 12/1981 Vine ..... 283/56

FOREIGN PATENT DOCUMENTS 549853 12/1942 United Kingdom ..... 141/390

*Primary Examiner*—Houston S. Bell, Jr.

[57] ABSTRACT

A "V"-shaped resilient member having a pair of opposing rectangular side flanges is used to place over the upper side portion of a conventional grocery bag to maintain the bag mouth in open position. The lower edges of the side flanges carry a plurality of coupons which are removably attached along perforated lines.

8 Claims, 3 Drawing Figures

FIGURE 1.
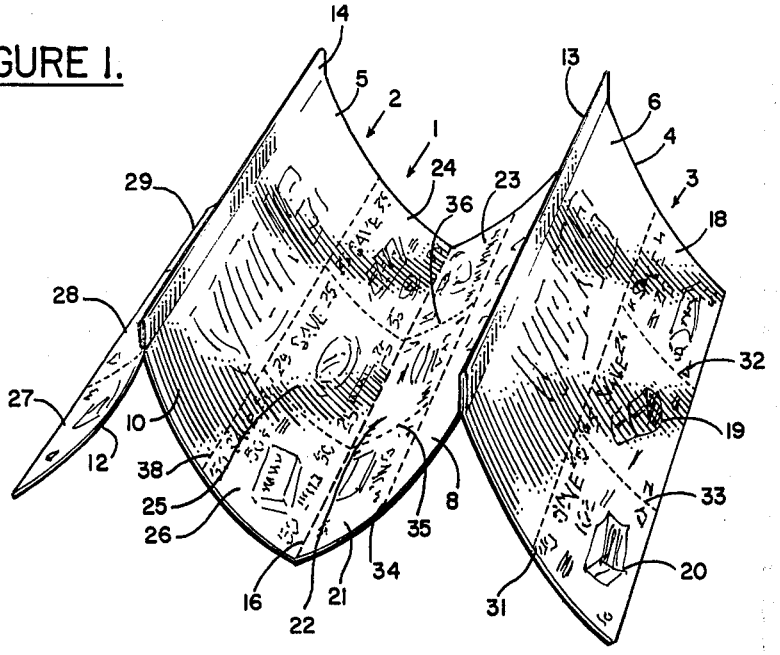
FIGURE 2.
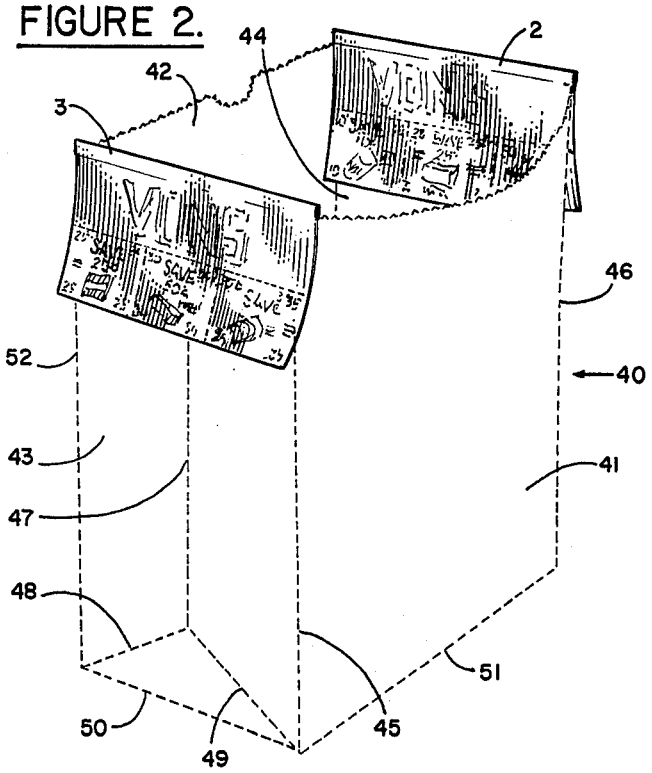
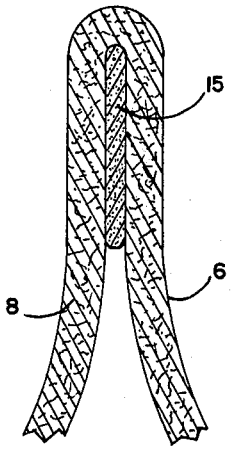
FIGURE 3.

COMBINATION COUPON CARRIER AND BAG STIFFENER

RELATIONSHIP TO OTHER CASES

This application is a continuation-in-part of application Ser. No. 255,540 filed Apr. 20, 1981, now U.S. Pat. No. 4,379,519, entitled Paper Bag Stiffener.

BACKGROUND OF THE INVENTION

This invention relates to stiffening members which are mounted over the upper edges of a paper bag to maintain the mouth of the bag in an open position and to prevent it from reverting to a folded position. More particularly it relates to a bag stiffening member which also carries a plurality of removable coupons.

It is common practice for supermarkets and variety stores to package customers' goods by placing them in a relatively tough, conventional paper bag. These paper bags or sacks are of a substantially standard size and shape, having a uniform rectangular horizontal cross-section and a flat bottom, and measuring approximately 12 inches long by 7 inches wide by 17 inches high. To enable a supermarket to conveniently store these bags for use, the bags are folded by creasing the opposing longitudinal side panels, permitting the opposing long panels to be folded together and the bottom panel to be folded alongside.

It is very common practice for purchasers of supermarket goods to save papers sacks for use around the home, e.g., as refuse receptacles. The bags may be placed inside of round or rectangular containers, such as waste baskets, or may simply be used themselves as freestanding containers, since the bags have sufficient rigidity to be self-maintaining in an upright position. The bag thereby serves as a handy disposable container for refuse. At the present time, millions of these bags are dispensed daily at no extra cost to the consumer.

A recurring and irritating problem associated with the use of paper sacks as refuse receptacles involves the "memory" of the bag which causes a tendency to return to its folded condition. When a bag is placed in upright position, the vertical creases in the opposing side panels tend to return to the folded condition, thereby closing the mouth of the bag. Accordingly, when refuse is thrown into the bag, it is necessary to reach over and open the mouth of the bag with one hand while jettisoning the refuse into the bag with the other hand.

The invention described in my co-pending application Ser. No. 255,540, now U.S. Pat. No. 4,379,519, solves this problem by providing a pair of stiffening members which slip over the upper edges of the creased side panels of the sack, thereby preventing the side panels from collapsing to their folded condition. The stiffening members described therein comprise a pair of rigid folded flaps which extend over the upper edges of the side panel which may be used in conjunction with a clip which extends over the flap to grip the flap in place on the side panel.

The prior art discloses certain devices which fit inside the openings of various types of bags to maintain the bag mouth in an open position. Kaiser, U.S. Pat. No. 791,472 and Boyle, U.S. Pat. No. 4,037,778, disclose various devices which can be inserted into the interior of limp plastic or cloth bags to provide support for holding the bags. Buttery, U.S. Pat. No. 2,430,155, also shows a holder for a plastic bag. A paper bag having its upper edges lined on the interior with a flexible but tough reinforcement member such as a wire as shown in Arai, U.S. Pat. No. 3,578,236. The internal wire permits the bag to be easily retained in the open or closed position; however, manufacture of the bag is somewhat more expensive than is justified by normal supermarket retailing operations.

The present invention relates to a combination device which is useful not only as a bag spreading means but is also useful for the distribution of advertising and discount coupons which are commonly used for supermarket products. These coupons are employed when the manufacturer or marketer of a particular product wishes to introduce a new product or to increase the demand for an existing product. Typically, coupons are distributed to potential purchasers, either by handout, mail, or by inclusion directly in a product. These coupons may entitle the bearer to a discount on future purchases, or may offer a cash refund, or make any of a variety of special offers. For coupons to be redeemed by retailers, the coupons generally contain on their face instructions to the retailer with regard to redemption and handling of the coupon after its receipt. For example, when a consumer redeems a $0.15 discount coupon on the purchase of dog food, the retailer must then return the coupon to the dog food manufacturer who in turn will pay the retailer the face value of the coupon plus a handling charge.

The present invention relates to a novel method of distributing coupons. In particular, it relates to devices which function not only as bag spreaders but also as coupon carriers, and are intended for distribution by retailers at the time consumer's products are being packed into sacks. Specifically, the invention provides a bag stiffening member having a pair of opposing side panels which extend over the upper edge of a bag, and which carries a plurality of removable advertising coupons.

It is an object of the present invention to provide a combination of a stiffening member for use with a paper bag to maintain the bag mouth in an open position with a plurality of removable advertising coupons. It is a further object of the invention to provide bag stiffeners having at least one lateral flange portion having a plurality of coupons removably attached to the bottom edge of the flange. These and other objects of the invention will be apparent from the following detailed description of a preferred embodiment thereof.

SUMMARY OF THE INVENTION

A bag stiffening device comprises an elongate V-shaped member having a pair of opposing flanges extending downwardly from the apex of the "V", at least one flange having a lower edge having a plurality of coupon members removably attached thereto.

BRIEF DESCRIPTION OF THE DRAWINGS

The invention is best understood with reference to the drawings, in which:

FIG. 1 is a perspective view of two bag stiffening members of the invention as manufactured, the two members being attached to each other along a perforated edge;

FIG. 2 is a perspective view showing two bag stiffening members of the invention, with coupon members attached, mounted over opposing sides of a paper bag; and FIG. 3 is a partial elevational side section view of an upper portion of the stiffening member.

DETAILED DESCRIPTION OF A PREFERRED EMBODIMENT

Referring to FIG. 1, a connected pair 1 of bag stiffening members 2 and 3 is shown as manufactured, with members 2 and 3 being connected along a perforated edge 16. In use, the members are simply pulled apart along edge 16, which is formed from very large perforations for easy separability. Coupons 2 and 3, which may have identical or entirely different printing thereon, are comprised of upper portions useful as bag stiffeners and lower portions which comprise a series of coupon members removably mounted to the lower edge of the bag stiffening portion.

Units 2 and 3 comprise folded flaps having a substantially "V" shape. The flap apex serves as means for attaching the units to the side panel of a bag. The upper bag stiffening portions 4 and 5 of the units are elongate flat rectangular side panels 6 and 8 for unit 3, and 10 and 12 for unit 2. These side flaps are flexible but strong, having approximately the characteristics of the material used in conventional manila folders, having a thickness of 1/32" or less. In principle, any material having sufficient strength to overcome the tendency of the side bag panels to fold inwardly may be used. The side panels extend downwardly from the apex of the V, denoted at 13 and 14 for units 3 and 2, respectively. The portion of each opposing flap adjacent to the apex of the V is glued together with a small amount of adhesive 15, best seen in the section view of FIG. 3. The adhesive tends to maintain the shape of the V, and to assure that the side panels maintain their opposing position as shown in FIG. 2. While the adhesive on the interior of the side panels adjacent the apex of the "V" is a preferred means of maintaining the side panels in close proximity to each other, other means, such as external clips, may be used.

Each flange of the stiffening member has a straight lower edge, shown as 31 and 34 for the bottom edges of panels 6 and 8, and edge 38 for the bottom portion of flange 10. Attached to the bottom edge of each flange are a series of removable tabs or coupon members. At the bottom edge of flange 6 are attached coupon members 18, 19, and 20; similar coupons 21, 22, and 23 are attached to the bottom portion of flange 8, coupons 24, 25, and 26 are attached to the bottom portion of flange 10, and coupons 27, 28, and 29 are attached along the bottom edge of panel 12. The information printed on the coupons may be the same or different, and forms no part of the invention. The coupons are defined by the horizontal perforations at the bottom edges of the flanges, and by a series of vertical perforations which extend along sides of the coupons from the horizontal perforation such as perforations 32 and 33, which along with the bottom edge of the flange 6 define coupons 18, 19, and 20. Similar vertical perforations are shown as 35 and 36 on the opposing flange 8 of bag stiffening unit 3.

The bag stiffeners of the invention may be mounted on a paper bag either with or without the coupons being attached thereto. Ordinarily, the coupons will be removed prior to the time that the stiffeners are mounted on the bag; however, the device of the invention functions equally well either after the coupons are removed or, as shown in FIG. 2, with the coupons remaining attached to the stiffener. FIG. 2 shows the bag stiffening units mounted over opposing upper side edges of a conventional grocery sack. The sack or bag 40 has front and back panels 41 and 42, respectively, and side panels 43 and 44. The bag has a rectangular cross-section which is substantially uniform from the top of the bottom of the bag. The bag has a flat bottom panel (not shown) which adjoins the vertical panels at the lower edges of which side edge 50 and longitudinal edge 51 are shown in the drawing. The vertical panels of the bag are defined by vertical edges 45, 46, and 52, and bottom edges 50 and 51 of the bag.

As conventionally folded, grocery bags have vertical creases at approximately the mid-point of opposing side panels, shown at 47 in FIG. 2. At its bottom end, the side crease 47 intersects two inwardly inclined creases extending from the corners of the bag, shown as creases 48 and 49. Additional horizontal folding lines in the bag are not shown in FIG. 2 and are not relevant or important to the invention.

The stiffening members 2 and 3 are placed over the upper edges of side panels 44 and 43 of the bags, respectively, with the side flanges of each stiffening member extending on opposite sides of each side bag panel. The length of each stiffening member is slightly longer than the length of each of the side panels of the bag (i.e., the distance between edges 45 and 52). The stiffener is about $\frac{1}{2}''$–$1\frac{1}{2}''$, preferably about 1", longer than the length (i.e., horizontal dimension) of the side panel. Typically for a bag having a 7" side panel, the stiffening member is about 8" long by about 2" high (without coupons). When the stiffener is set in place over the upper edge of the bag, the bag mouth is forced into a somewhat oval shape because the edges of the stiffener extend beyond the edges of the side panel, forcing the front and rear panels into a bowed configuration as shown in FIG. 2. This configuration is particularly helpful in maintaining a wide opening into which refuse may be placed. As shown in FIG. 2, the stiffeners are pulled forward toward the front of the bag, thereby forming an exaggerated curvature of the upper portion of front panel 41. This configuration would be particularly useful, for example, if the bag were in place in a cabinet under a sink.

The stiffener/coupon carrier of the invention is easily manufactured by cutting a flat strip of stiff paper of the length and width of the entire double unit shown in FIG. 1, and printing both sides of the paper as necessary. The units are then perforated along the coupon edges and along the edge adjoining the two units 16, and each unit is then glued and folded to form the flat portion at the apex of the V. Any manufacturing procedure of course may be used; for example, the units may be cut from a very long printed strip which comprises a large number of units.

An alternate design for the stiffening member comprises a single flat panel having attachment means for fastening the panel to a paper bag surface. The attachment means preferably comprises an adhesive material which has been placed on one side of the panel, for example an adhesive strip which extends along the entire length of the panel and is covered by a flexible plastic strip. When the user wishes to place the stiffening member on the bag, the plastic or coated paper strip is peeled away, and the panel is pressed on the side of the bag. These single panels also carry a plurality of perforated coupons along the bottom edge.

Any type of stiffening material and construction may be used in accordance with the invention, as long as it accomplishes the function of retaining the bag in an open position and carrying the coupons on the member.

The stiffeners may be made from paper, plastic, or any other material; the material is generally dependant upon cost, since it is essential to keep the cost as low as possible. In principle, any member which can be slid in place over the upper edge of the bag panel and which has sufficient stiffness to retain the bag mount in the open position may be used. In particular, the members having a clip portion at the top, or a styrofoam member, each of which is disclosed in my copending application Ser. No. 255,540, now U.S. Pat. No. 4,379,519 which is incorporated herein by reference, may be used.

The units of the invention are easily distributed by having the supermarket place a pair of stiffening units, either in combination as shown in FIG. 1 or individually, in the bag of each customer as groceries are placed in the bag. The customer may then detach whatever coupons that he desires to use, and may then use the stiffener to maintain the bag in open position for use as a refuse bag. The stiffeners are extremely inexpensive to manufacture and may be discarded along with the bag when it is full of refuse. The panels of the stiffener may be decorated with art work, advertising, or names of particular markets. A number of alternatives will be immediately clear to those skilled in the art, and the invention should not be considered limited by the specific embodiments disclosed herein. Rather, the invention should be considered limited only by the following claims.

I claim:

1. In combination, a bag stiffener/coupon carrier device comprising at least one flat strengthening member having a lower edge, means to attach the strengthing member to a side panel of a paper bag, and at least one coupon member removably attached to the lower edge of the strengthening member, and a bag adapted to be maintained in an open position or a folded position, the bag having front, rear, and opposing side bag panels defining a rectangular horizontal cross-section when the bag is in the open position, upper edges of said bag panels defining a bag mouth, the opposing side bag panels having intermediate vertical creases therein.

2. The combination of claim 1 comprising a substantially "V"-shaped member having a pair of generally rectangular side panels extending from the apex of the "V", at least one panel having a plurality of coupon members attached to the lower edge thereof.

3. The combination of claim 1 wherein the lower edge is straight, and the device also comprises a plurality of coupon members removably attached thereto.

4. The combination of claims 1 or 3 wherein the coupon members are attached along a perforated line extending along the lower edge of the strengthening member.

5. The combination of claim 2 also comprising means to maintain the side panels in close proximity to each other.

6. The combination of claim 2 wherein an interior portion of each side panel immediately adjacent the apex of the "V" is adhesively attached to the opposing side panel.

7. The combination of claim 2 having a plurality of coupon members attached to lower edges of each side panel, the coupon members being attached to the side panels along straight perforated lines, and each coupon member being attached to each immediately adjacent coupon member along a straight perforated line.

8. The combination of claim 1 wherein the bag stiffener/coupon carrier device is removably attached to the upper edge of an opposing side panel to maintain the bag mouth in an open position.

* * * * *